United States Patent [19]

Chao et al.

[11] Patent Number: 5,038,804

[45] Date of Patent: Aug. 13, 1991

[54] SMOKING DEVICE

[75] Inventors: Li-Chung Chao; Jiunn-Yann Tang, both of Louisville, Ky.

[73] Assignee: Brown & Williamson Tobacco Corporation, Louisville, Ky.

[21] Appl. No.: 303,223

[22] Filed: Jan. 30, 1989

[51] Int. Cl.[5] ..... A24B 15/28; A24D 1/18

[52] U.S. Cl. ..... 131/359; 131/369; 131/194

[58] Field of Search ..... 131/359, 369, 194

[56] References Cited

FOREIGN PATENT DOCUMENTS 1185887 8/1982 United Kingdom .

*Primary Examiner*—V. Millin

*Attorney, Agent, or Firm*—Charles G. Lamb

[57] ABSTRACT

A smoking device having a cylindrical fuel rod circumscribed by an air impermeable wrapper. The fuel rod consists of a homogeneous mixture of a non-tobacco fuel, a non-combustible tobacco, an aerosol generating material and a heat sink material.

11 Claims, 1 Drawing Sheet

SMOKING DEVICE

BACKGROUND OF THE INVENTION

The present invention relates to smoking devices, and more particularly, to a smoking device which includes a fuel rod consisting of a non-combustible tobacco, a non-tobacco fuel, an aerosol generating material and flavor generating material.

A smoking article including a tobacco and a non-tobacco fuel are, per se, known. For example, U.S. Pat. No. 2,907,686 teaches a substitute for tobacco which is an activated or non-activated carbon impregnated with a flavoring oil such as vanilla; U.S. Pat. No. 2,976,190 teaches a cigarette having a tobacco column wrapped by conventional cigarette paper wherein the interior surface of the paper wrapper, that is the surface in contact with the tobacco column, is coated with metal particles and the metal particles absorb heat to reduce the temperature of the burning cigarette; U.S. Pat. No. 3,258,015 teaches a smoking device having a cylindrical tobacco rod which can have mixed therein a smoldering enhancing compound such as sodium chlorate, potassium chlorate, sodium nitrate or potassium nitrate and includes a metal tube extending coaxially through the tobacco rod filled with tobacco or a tobacco extract and an aerosol forming material; U.S. Pat. No. 3,674,036 teaches a cigarette having a tobacco rod in axial alignment with a filter rod with a porous partition being located at the interface of the tobacco rod and filter, the tobacco rod being provided with a thin walled, tubular perforated core coaxially embedded in the tobacco rod wherein the core is fabricated of a thin combustible paper and the filter rod is provided with a recess to catch liquid concentrate and impurities of combustion; U.S. Pat. No. 4,340,072 teaches a smoking device having a cylindrical air impervious fuel rod with a central passage therethrough and a chamber located at one end of the fuel rod with a filter located at the end of the chamber wherein the chamber is formed of an air impermeable material containing an aerosol precursor of a volatile flavor solution and the fuel rod is formed of a tobacco substitute and carbon; U.S. Pat. No. 4,510,950 teaches a cigarette having a combustible fuel rod fabricated of a mixture of tobacco particles and a filler of calcium carbonate, magnesium carbonate, calcium oxide, magnesium oxide, calcium hydroxide, magnesium hydroxide, alumna, hydrated alumna, clay or silica and the fuel rod has a density within the range of from 0.05 to about 1.5 gcc; and, European Patent Application No. 0245732 teaches a smoking article having a cylindrical fuel element fabricated of a pyrolyzed non-tobacco fibrous material with a stainless steel tube centrally located with the fuel element filled with a substrate material bearing aerosol forming substances wherein the substrate can be carbon, ceramics, or metal and the aerosol forming substances can be polyhydric alcohols.

SUMMARY OF THE INVENTION

The present invention provides a smoking article comprising a fuel rod comprising a homogeneous mixture of a non-combustible tobacco; a non-tobacco fuel; an aerosol generating material which aerosolizes at a temperature below the burning temperature of the non-tobacco fuel; an air impermeable paper wrapper circumscribing the fuel rod; and, a coaxially extending filter rod at one end of the fuel rod.

BRIEF DESCRIPTION OF THE DRAWINGS

A better understanding of the invention will be had upon reference to the following description in conjunction with the accompanying drawings in which like numerals refer to the parts throughout the several views and wherein.

DETAILED DESCRIPTION OF THE PREFERRED EMBODIMENT

Figure 1:
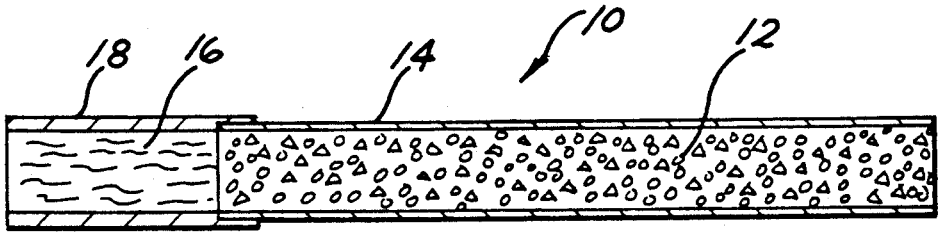
FIG. 1 is a longitudinal cross-sectional view of one advantageous embodiment of a smoking article of the present invention.

With reference to FIG. 1, there is shown a smoking device, generally denoted as the numeral 10, of the present invention which includes a cylindrical fuel rod 12, an air impermeable paper wrapper 14 circumscribing the fuel rod 12, and a filter 16 coaxially located at one end of the fuel rod 12 and attached to the fuel rod 12 by a tipping material 18 circumscribing the filter 16 and overlapping the end of the fuel rod 12 adjacent the filter 16.

The fuel rod 12 is a homogeneous mixture comprising a non-combustible tobacco, a non-tobacco fuel, an aerosol generating material, a flavor generating material, and a heat absorbent material. An appropriate binder can also be included in the mixture as a cohesive to hold the other components together.

The non-tobacco fuel is preferably selected from a group of materials such as, for example, charcoal, aluminum, or magnesium. The non-tobacco fuel is in the form of small particulate or powder to provide increased surface area.

The non-combustible tobacco can be, for example, reconstituted tobacco treated with a burn retardant material, such as diammonium phosphate, mono ammonium phosphate and ammonium polyphosphate to raise the combustion temperature of the tobacco to above the combustion temperature of the non-tobacco fuel. Preferably, the non-combustible tobacco comprises no more than 20 g by weight of the fuel rod.

The aerosol generating material forms an aerosol or aerosolizes below the combustion temperature of the non-tobacco fuel. The aerosol generating material can be, for example, glycerine or propylene glycol.

The flavor generating material is preferably a material which will release flavors by diffusion into the aerosol at a temperature below the combustion temperature of the non-tobacco fuel. Tobacco extracts and menthol are examples of such flavors.

The heat absorbent material is included in the fuel rod as a heat sink for the absorption of heat and to control the temperature of the mixture. The heat absorbent material can be an inert metal oxide, such as alumna or magnesium oxide.

The binder material can be of the type typically used in conventional cigarettes, for example, sodium carboxymethylcellulose, pectin, and hydroxypropylcellulose.

The smoking device 10 of FIG. 1 can be made by conventional cigarette making processes. In such known process the components of the fuel rod are mixed together and formed into a sheet and can be cut and formed into a rod like tobacco in a conventional cigarette. The sheet can also be attenuated and rolled into cylindrical form wrapped in the paper wrapper 14, and cut to a preselected length.

Figure 2:
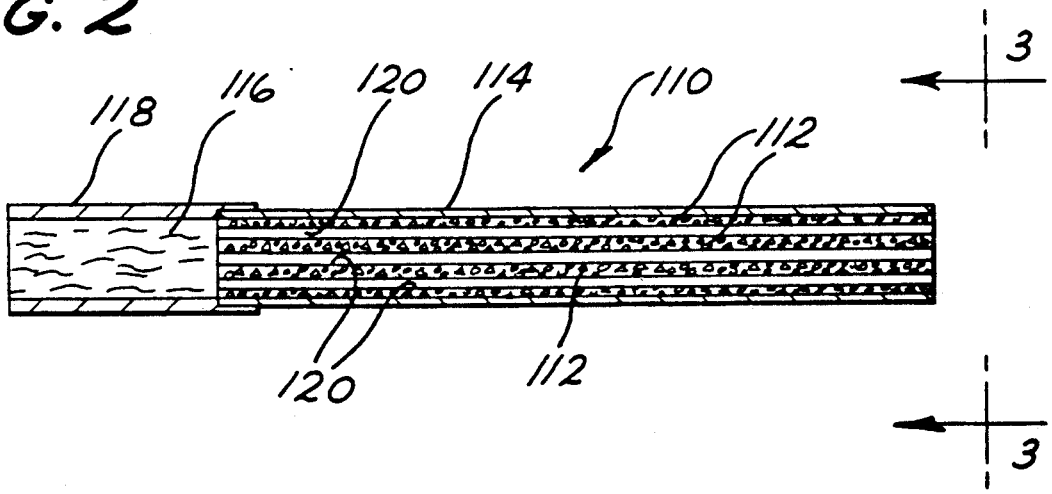
FIG. 2 is a longitudinal cross-sectional view of another advantageous embodiment of a smoking article of the present invention; and, FIG. 3 is an end view of the smoking article of FIG. 2 as seen in the direction of arrows 3—3 in FIG. 2.
Figure 3:
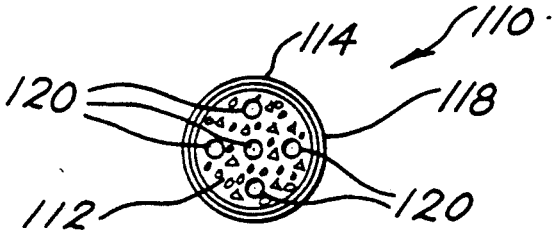

Now with reference to FIGS. 2 and 3, there is shown another embodiment of a smoking device, generally denoted as the numeral 110, of the present invention which includes a cylindrical fuel rod 112, an air impermeable paper wrapper 114 circumscribing the fuel rod 112, and a filter 116 coaxially located at one end of the fuel rod 112 and attached to the fuel rod 112 by a tipping material 118 circumscribing the filter 116 and overlapping the end of the fuel rod 112 adjacent the filter 116. The fuel rod 112 is formed with a plurality of channels 120 extending longitudinally through the fuel rod from one end to the other end of the fuel rod 112. As shown, there are five channels 120 oriented such that one channel 120 extends concentrically through the fuel rod, and the other four channels are in a circumferentially spaced array around the concentrically disposed channel. Preferably, the distance between the concentrically disposed channel and each one of the other channels measured radially of the fuel rod 112 is equal to the distance separating adjacent ones of the other channels 120.

As with the fuel rod 12, the fuel rod 112 is a homogeneous mixture comprising a non-combustible tobacco, a non-tobacco fuel, an aerosol generating material, and a heat absorbent material.

The fuel rod 112 is a homogeneous mixture comprising a non-combustible tobacco, a non-tobacco fuel, an aerosol generating material and a heat absorbent material all of the type discussed above in regard to the smoking device 10 of FIG. 1.

The fuel rod 112 is compressed to a higher density than that of the tobacco rod of a conventional cigarette or that of the fuel rod 12. The density of the fuel rod 112 is in the range of 0.4 gm/cc to 1.5 gm/cc. Due to the higher density, the combustion temperature of the tobacco component is increased to the extent that the amount of burn retardant material can be reduced from that used in the fuel rod 12, and possibly even be eliminated from the fuel rod 112. The channels 120 are used to supply combustion supporting air to the interior of the fuel rod 112 as a smoker draws the filter 116.

In addition, if need be, an oxidizer material can be mixed with the other components of the fuel rod 112 to supply further combustion supporting oxygen. One suitable oxidizer material is potassium nitrate.

The fuel rod 112 can he made by forming a suitable slurry of the fuel rod components and extruding the slurry to form the higher density fuel rod 112. The channels 120 can be formed during the extrusion of the fuel rod.

In both of the embodiments described above, the heat generated by the burning non-tobacco fuel component will vaporize the volatiles in the tobacco. The aerosol generated by the aerosol generating material will pick up or entrain these released volatiles and carry them to the mouth of the smoker.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A smoking article comprising:

a) a fuel rod comprising a homogeneous mixture of a non-combustible tobacco, a non-tobacco fuel, a heat sink material, and an aerosol generating material which aerosolizes at temperatures below the burning temperatures of the non-tobacco fuel, the tobacco component of the fuel rod comprising no more than 20% by weight of the fuel rod;

b) a combustible wrapper circumscribing the fuel rod; and c) a coaxially extending filter rod at one end of the fuel rod whereby upon ignition there is a direct flow of generated combustion products to said filter rod.

2. The smoking article of claim 1, wherein the fuel rod further comprises an inert metal oxide as the heat sink homogeneously mixed with the other components of the fuel rod.

3. The smoking article of claim 1, wherein the fuel rod has a density sufficient to prevent the tobacco from igniting upon burning of the non-tobacco fuel.

4. The smoking article of claim 3, wherein the fuel rod has a density of from 0.4 gm/cc to 1.5 gm/cc.

5. The smoking article of claim 3, wherein the tobacco is treated with a burn retardant material.

6. The smoking article of claim 5, wherein the burn retardant material is selected from the group of diammonium phosphate, monoammonium phosphate, and ammonium polyphosphate.

7. The smoking article of claim 1, wherein the fuel rod further comprises a flavor releasing material homogeneously mixed with the other components of the fuel rod.

8. The smoking article of claim 1, wherein the tobacco is treated with a burn retardant material.

9. The smoking article of claim 1, wherein the fuel rod is formed with a plurality of longitudinally extending channels.

10. The smoking article of claim 9, wherein the channels extend the entire length of the fuel rod.

11. The smoking article of claim 1, wherein the wrapper is air impermeable.

* * * * *